US005219155A

United States Patent [19]

Kanome

[11] Patent Number: 5,219,155

[45] Date of Patent: Jun. 15, 1993

[54] SHEET FEEDING APPARATUS

[75] Inventor: Yuji Kanome, Kawasaki, Japan

[73] Assignee: Canon Kabushiki Kaisha, Tokyo, Japan

[21] Appl. No.: 778,358

[22] Filed: Oct. 17, 1991

[30] Foreign Application Priority Data

Oct. 24, 1990 [JP] Japan ..... 2-286684

[51] Int. Cl.[5] ..... B65H 3/06

[52] U.S. Cl. ..... 271/114; 271/121; 271/127

[58] Field of Search ..... 271/114, 117, 118, 121, 271/126, 127

[56] References Cited

U.S. PATENT DOCUMENTS

| | | | |
|---|---|---|---|
| 4,319,740 | 3/1982 | Ulseth | 271/22 |
| 4,346,878 | 8/1982 | Aizawa | 271/118 |
| 4,699,366 | 10/1987 | Kashimura | 271/4 |
| 4,717,139 | 1/1988 | Sootome et al. | 271/126 X |

FOREIGN PATENT DOCUMENTS

| | | | |
|---|---|---|---|
| 0320246 | 6/1989 | European Pat. Off. . | |
| 0376308 | 7/1990 | European Pat. Off. . | |
| 3222637 | 1/1983 | Fed. Rep. of Germany . | |
| 3243537 | 6/1983 | Fed. Rep. of Germany . | |
| 3708601 | 10/1987 | Fed. Rep. of Germany . | |
| 0123729 | 5/1988 | Japan | 271/114 |
| 0193830 | 7/1990 | Japan | 271/114 |
| 1168202 | 10/1969 | United Kingdom | 271/39 |

*Primary Examiner*—H. Grant Skaggs
*Assistant Examiner*—Carol Lynn Druzbick
*Attorney, Agent, or Firm*—Fitzpatrick, Cella, Harper & Scinto

[57] ABSTRACT

A sheet feeding apparatus comprising a support for supporting stacked sheets, a rotary sheet feed device for feeding out the sheets supported by the support, and a separating device for separating the sheets fed out from the rotary sheet feed device one by one. The support is shiftable between a feed position where the stacked sheets are abutted against the rotary sheet feed device and a waiting position where the stacked sheets are separated from the rotary sheet feed device. There is provided a switch connected to a rotary drive source for driving the rotary sheet feed device and adapted to shift the support to the feed position through a rotation of the rotary drive in one direction and to shift the support to the waiting position through a rotation of the rotary drive in the other direction.

13 Claims, 8 Drawing Sheets

SHEET FEEDING APPARATUS

BACKGROUND OF THE INVENTION

1. Field of the Invention

The present invention relates to a sheet feeding apparatus for separating and feeding sheets one by one, and more particularly, it relates to a drive mechanism for such a sheet feeding apparatus.

2. Related Background Art

In some conventional sheet feeding apparatuses, when sheets were stacked on a sheet support means, a sheet urging means for biasing the sheets upwardly was automatically separated from a sheet supply means to facilitate the stacking of the sheet, and when the stacked sheets were separated and fed, the urging means was automatically urged against the sheet supply means.

In the sheet feeding apparatus of this type, even when the sheet supply means and a switching means for switching the urging means between the separated condition and the urged condition (with respect to the sheet supply means) were driven either by respective drive sources or by a common drive source, the apparatus included a driving force switching means, such as a solenoid or wedge, for switching the transmission of a driving force to the sheet supply means or to the switching means, and/or a sensor for detecting a condition of the switching means.

However, in the above-mentioned conventional apparatus, there arose a problem in that it was made expensive when the respective drive sources were prepared for the sheet supply means and the switching means, respectively. In addition, when the sheet supply means and the switching means were driven by the common drive source, it was necessary to provide the driving force switching means for distributing the driving force or the sensor for detecting the condition of the switching means, thus making the apparatus expensive.

SUMMARY OF THE INVENTION

In consideration of the above conventional drawbacks, an object of the present invention is to provide a sheet feeding apparatus wherein an urging means can be shifted between a separated condition and an urged condition by means of a single drive source with a simple construction.

In order to achieve the above objects, the present invention provides a sheet feeding apparatus comprising a support means for supporting stacked sheets, a rotary sheet supply means for feeding out the sheets supported by the support means, and a separating means for separating the sheets fed out from the rotary sheet supply means one by one. The support means is shiftable between a supply position, where the stacked sheets are abutted against the rotary sheet supply means, and a waiting position where the stacked sheets are separated from the rotary sheet supply means. Further there is provided a switching means connected to a rotary drive source for driving the rotary sheet supply means and adapted to shift the support means to the supply position through a rotation of the rotary drive means in one direction and to shift the support means to the waiting position through a rotation of the rotary drive means in the other direction.

More specifically, when a normal rotation of the rotary drive means is transmitted, the rotary sheet supply means is rotated to feed out the sheets. The switching means shifts the support means to the supply position upon the normal rotation of the rotary drive source, and shifts the support means to the waiting position upon a reverse rotation of the rotary drive means.

With this arrangement, upon the normal rotation of the rotary drive source, the rotary sheet supply means is rotated in the direction for feeding out the sheets and at the same time the switching means causes the support means supporting the sheets to shift to the supply position, whereby the sheets are fed out from the support means and are separated by the separating means one by one.

On the other hand, when the rotary drive source is rotated in the reverse direction, since the support means is shifted to the waiting position, it is possible to load the sheets between the support means and the rotary sheet supply means.

In this way, only by rotating the rotary drive source in the normal and reverse directions, it is possible to shift the support means to the supply position and the waiting position, respectively, thus making the construction of the apparatus simple.

DETAILED DESCRIPTION OF THE PREFERRED EMBODIMENTS

The present invention will now be explained in connection with embodiments thereof with reference to the accompanying drawings.

Figure 1:
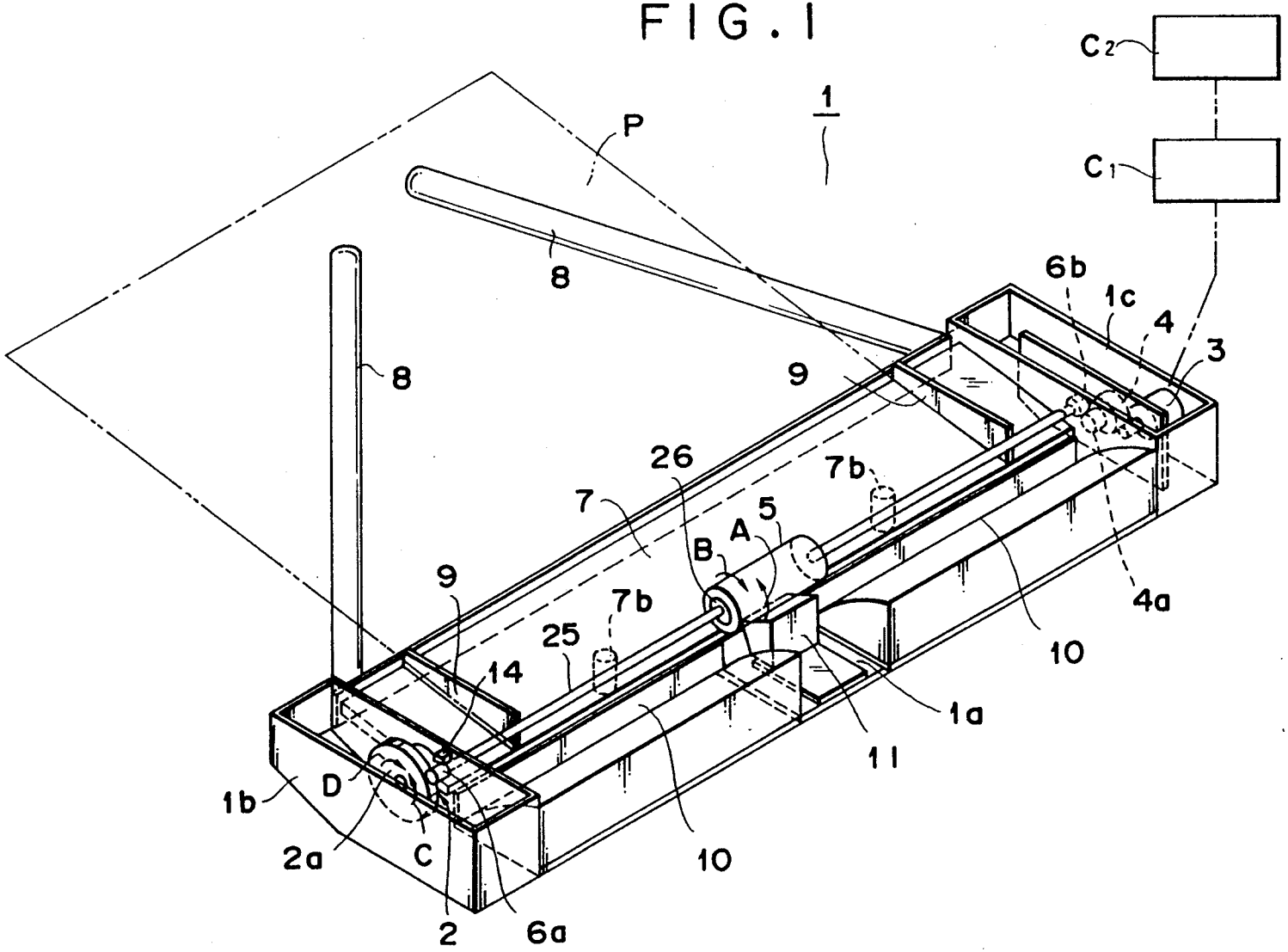
FIG. 1 is a perspective view of a sheet feeding apparatus according to a preferred embodiment of the present invention.

In FIG. 1 generally showing a sheet feeding apparatus 1 according to a preferred embodiment of the present invention as a perspective view, the sheet feeding apparatus comprises a flat base 1*a* on which left and right frames 1*b*, 1*c* are formed at both ends thereof. A clutch 2 is mounted on the frame 1*b*, and a stepping motor 3 (referred to merely as "motor" hereinafter) and a reduction gear set 4 are mounted on the frame 1*c*. A sheet supply roller 5 has an elastic outer surface made of rubber and the like and also has a one-way clutch 26 incorporated therein. A shaft 25 is connected to the sheet supply roller 5 via the one-way clutch 26, and gears 6a, 6b are fixedly mounted on both ends of the shaft 25. The gears 6a, 6b are meshed with an input gear 2a of the clutch 2 and an output gear 4a of the reduction gear set 4, respectively.

Figure 3:
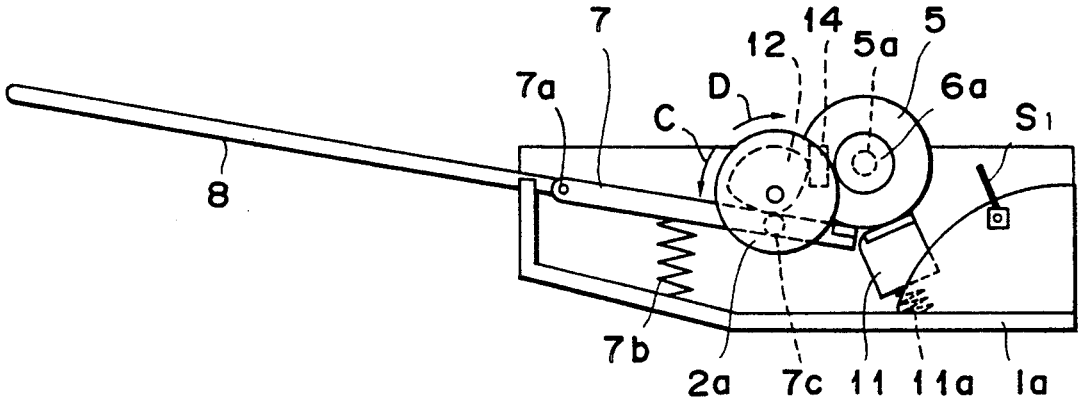
FIG. 3 is an elevational sectional view of the sheet feeding apparatus showing a sheet feeding condition.

As shown in FIGS. 1 and 3, an urging plate 7 for urging sheets P upwardly is rotatably mounted on a shaft 7a and is biased upwardly by means of a compression spring 7b. In the proximity of the shaft 7a, a sheet stacking support 8 having a pair of branches converging outwardly is attached to the base 1a to be flush with an upper surface of the urging plate 7.

A pair of regulating plates 9, for regulating lateral edges of the sheets P, are disposed on the upper surface of the urging plate 7 at both ends thereof and abutment plates 10, against which leading ends of the sheets are abutted, are uprightly formed on the base 1a. Further, a separating pad 11, for separating the sheets P one by one is disposed between the abutment plates 10 and is baised upwardly by means of a spring 11a shownin FIGS. 3 and 4 to be urged against the sheet supply roller 5. At a downstream side of the sheet supply roller 5, there is disposed a sensor $S_1$ for detecting a trailing end of the sheet P.

Next, the clutch 2 and a switching cam 12 for urging against or separating from the urging plate 7 with respect to the sheet supply roller 5 will be explained with respect to FIGS. 2, 3 and 4.

The clutch 2 incorporates therein the switching cam 12 in such a manner that the cam is mounted on a cylindrical portion 13 protruded from the input gear 2a via a clutch spring 2b, so that, when the input gear 2a is rotated in one direction (normal direction), a rotational force is transmitted from the gear to the switching cam 12, but when the gear is rotated in the other direction, the rotational force is not transmitted to the cam.

A compression spring 2c is mounted around the switching cam 12, and an inner surface of the switching am 12 is urged against a portion 2d (shown by a hatched area in FIG. 2) of the input gear 2a so that the rotational force can be loosely transmitted from the input gear to the cam via the contacting area therebetween.

When the input gear 2a is rotated in a direction shown by the arrow D (normal direction), the switching cam 12 can also be rotated in the direction D, since it is loosely connected to the input gear. However, when the switching cam 12 is abutted against a stopper 14, a further rotation of the cam is prevented, with the result that a relative slipping movement occurs between the input gear and the switching cam through the contacting area 2d. Thus, since a cam follower 7c formed on a side surface of the urging plate 7 contacts with a lower lift profile of the switching cam 12, the urging plate 7 is urged against the sheet supply roller 5 by means of the compression spring 7b. When the input gear 2a is rotated in a direction shown by the arrow C (reverse direction), the clutch 2 is engaged, with the result that the switching cam 12 is also rotated in the direction C (reverse direction), thus pushing up the cam follower 7c with a higher lift profile of the cam in opposition to a biasing force of the compression spring 7b.

Figure 4:
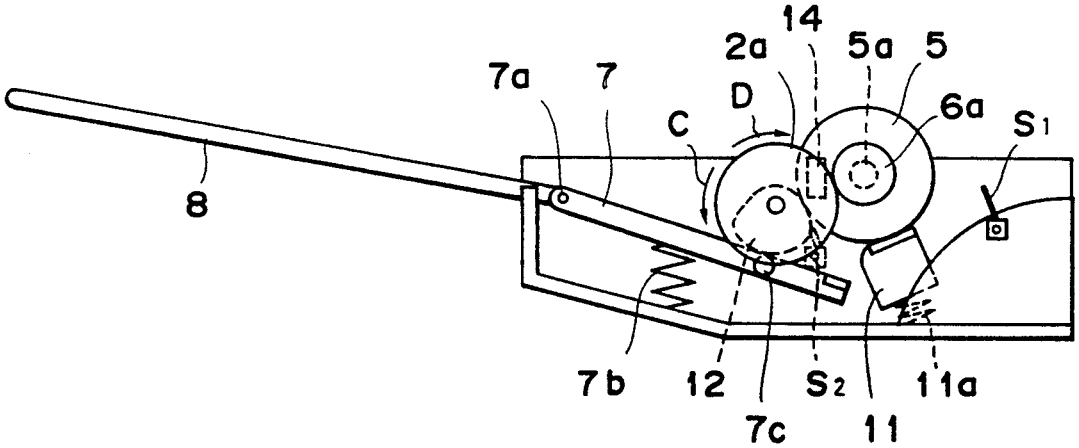
FIG. 4 is an elevational sectional view of the sheet feeding apparatus showing a sheet stacking condition.

Incidentally, when a condition shown in FIG. 4 is attained, the motor 3 (FIG. 1) is stopped.

In this case, since the motor 3 is a stepping motor, it is possible to obtain the condition shown in FIG. 4 by stopping the motor after a predetermined number of pulses of the motor are counted from the initiation of the motor. Further, by providing a sensor $S_2$, for detecting the condition of the cam 12 shown in FIG. 4, the motor 3 may be stopped when the sensor $S_2$ detects the switching cam 12.

Incidentally, in FIG. 1, the reference symbol $C_1$ denotes a control means (CPU) incorporated into the sheet feeding apparatus 1 and adapted to control the motor 3; and $C_2$ denotes a control means (CPU) incorporated into an image forming system and adapted to control the initiation of the sheet supply by sending a sheet supply signal to the control means $C_1$.

Figure 5:
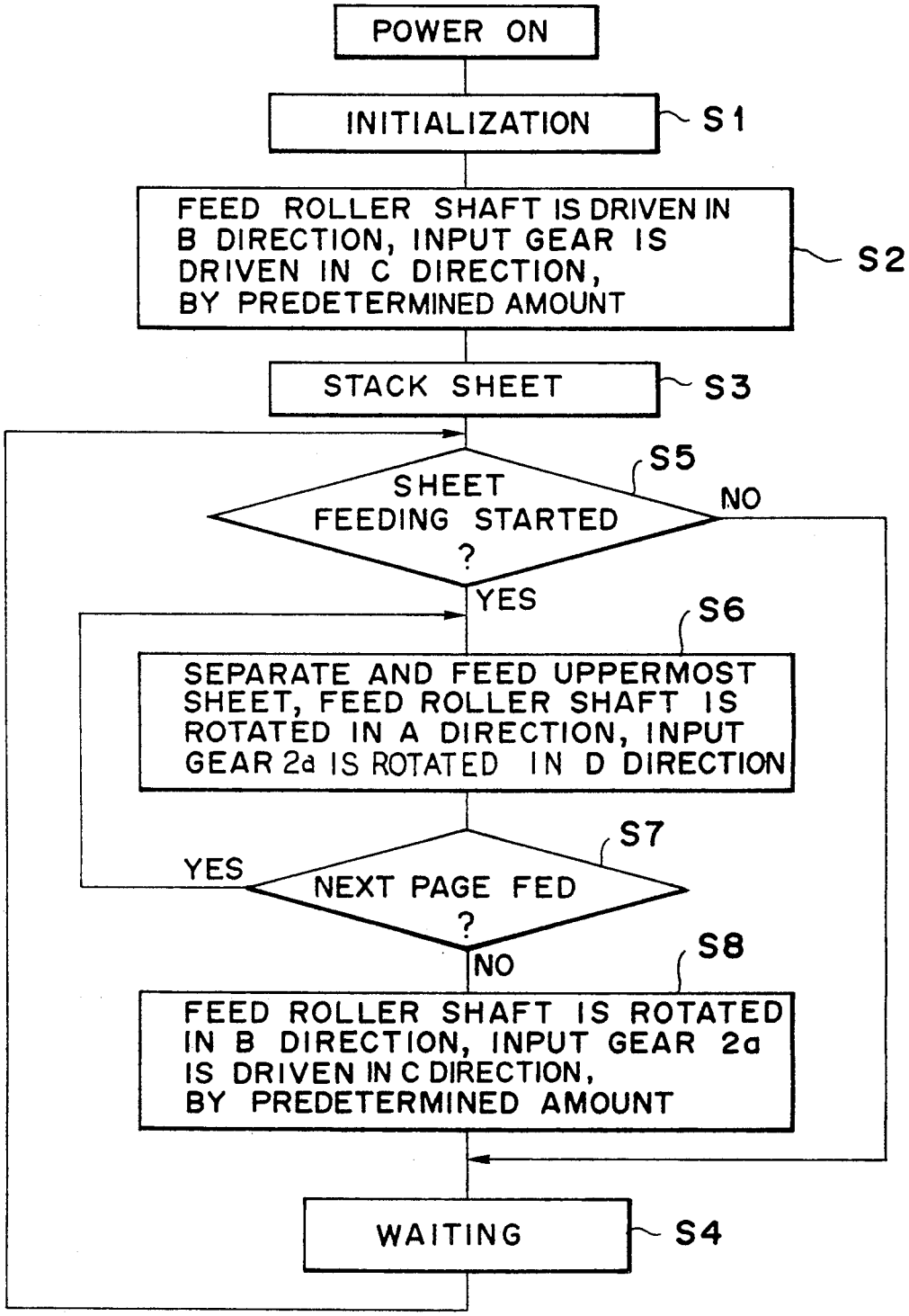
FIG. 5 is a flow chart associated with the apparatus of FIG. 1.

Next, an operation of the sheet feeding apparatus according to this embodiment will be explained with reference to a flow chart shown in FIG. 5.

In a step S1, the initialization is performed. That is to say, when a power source is turned ON, since it is not clear where the switching cam 12 is now positioned, a home position of the switching cam 12 is firstly set. To this end, a position where the switching cam 12 is abutted against the stopper 14 is regarded as the home position. In order to obtain this condition, since the condition shown in FIG. 4 indicates the fact that the switching cam 12 is furthest from the stopper 14, after the power source is turned ON, the motor 3 is rotated in the normal direction by the number of pulses slightly greater than the above-mentioned predetermined number of pulses (required to restore the condition shown in FIG. 4 from the condition shown in FIG. 3 by rotating the motor 3 reversely). Consequently, the switching cam 12 is abutted against the stopper 14, thus establishing the home position. Incidentally, although the sheet is fed out by the sheet supply roller 5 during this normal rotation of the motor, since a feeding amount of the sheet in this case is a little, it does not affect a bad influence upon the further feeding of the sheet.

Incidentally, if the sensor $S_2$ is provided for detecting the fact that the switching cam 12 reaches the condition of FIG. 4, after the power source is turned ON, the switching cam 12 may be rotated reversely until the sensor $S_2$ detects the switching cam 12. If the sensor $S_2$ is provided, since a home position of the cam corresponds to the condition of FIG. 4, a step S2 described hereinbelow can be omitted.

Then, when the motor 3 is rotated reversely by the predetermined number of pulses, the input gear 2a is rotated in the direction C by a predetermined amount via the reduction gear set 4, gear 6b and shaft 25. Incidentally, since the one-way clutch 26 is not engaged, the sheet supply roller 5 does not rotate. In this case, the clutch 2 is engaged, as mentioned above, with the result that the switching cam 12 is rotated from the position of FIG. 3 where the cam is abutted against the stopper 14 to the position of FIG. 4 where the maximum lift profile of the cam is oriented downwardly. Consequently, the urging plate 7 is lowered in opposition to the biasing force of the compression spring 7b by the switching cam 12 via the cam follower 7c. Thus, the urging plate 7 is separated from the sheet supply roller 5 and is stopped there (step S2).

In this condition, the sheets P are stacked on the stacking support 8 so that the leading ends of the sheets are abutted against the abutment plates 10 (step S3).

Now, when the sheet is not desired to be fed, the condition is maintained as it is, i.e., a waiting condition (step S4).

To the contrary, when a sheet supply signal, from the control means $C_2$ of the image forming system, is inputted to the control means $C_1$ (step S5), the motor 3 is rotated in the normal direction, with the result that the sheet supply roller 5 is rotated in the direction A (FIG. 1) via the reduction gear set 4, gear 6*b*, shaft 25 and one-way clutch 26.

At the same time, the input gear 2*a* is rotated in the direction D via the shaft 25 and gear 6*a*. Consequently, since the switching cam 12 is loosely connected to the input gear 2*a* by the action of the clutch 2, the switching cam 12 is rotated to be abutted against the stopper 14 as shown in FIG. 3 and is stopped there. As a result, since the lowest lift profile of the cam faces to the urging plate 7 on which the sheets are stacked, the urging plate is urged against the sheet supply roller 5 with the interposition of the sheets by the biasing force of the compression spring 7*b*, so that the sheets P can be fed by a friction force between the sheet supply roller 5 and the sheet as mentioned above (step S6).

After the sheet supply signal to the control means $C_1$ is stopped, when the trailing end of the sheet P is detected by the sensor $S_1$, it is judged that the feeding of the sheet is finished (step S7), and the operation similar to that in the step S2 is repeated (step S8), and then the waiting condition is maintained (step S4).

Figure 2:
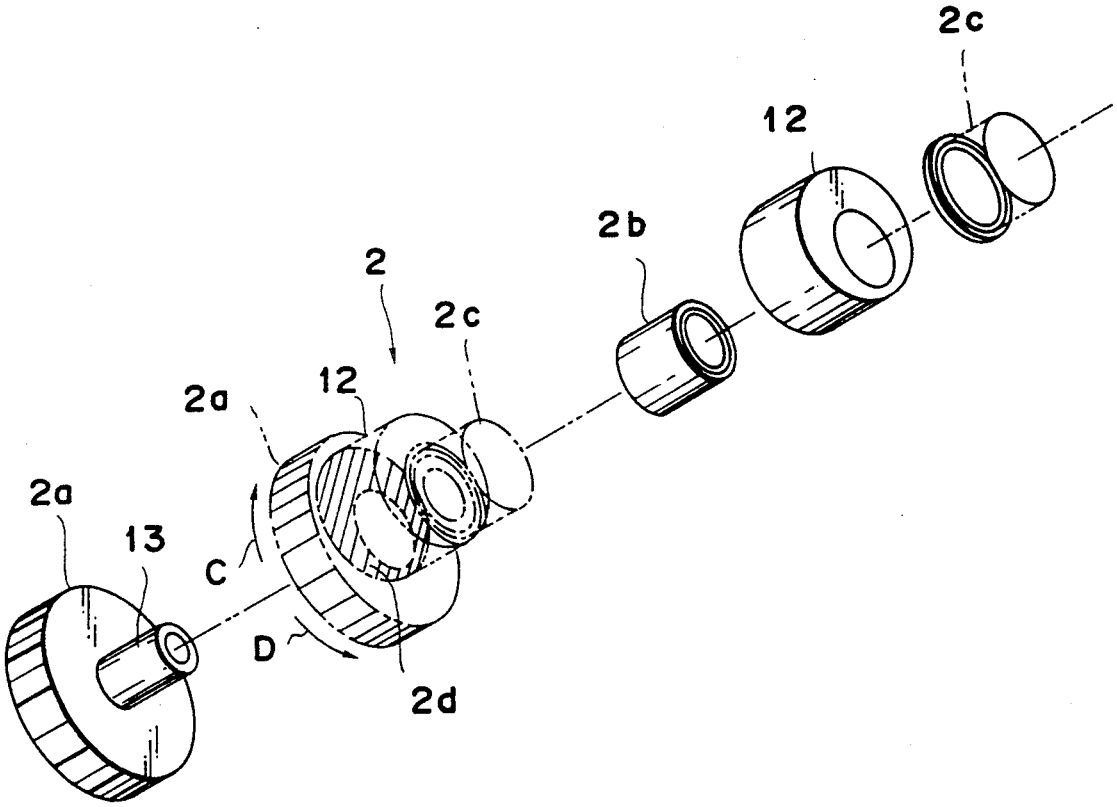
FIG. 2 is an exploded perspective view showing the assembling of a clutch means and a switching means of the apparatus.

Incidentally, in the present invention, it is not limited to the compression spring 2*c* as shown in FIG. 2, but, for example, any elastic member such as rubber may be used, alternatively. Further, in the illustrated embodiment, while the motor 3 acting as the drive source was mounted on the frame 1*c*, any external drive source may be used. In addition, while the separating pad was used, a separating pawl or any other frictional separating means may be used.

Next, another embodiment will be explained with reference to FIG. 6. Hereinafter, the same or similar constructural elements are designated by the same reference numerals and the detailed explanation thereof will be omitted.

Figure 6:
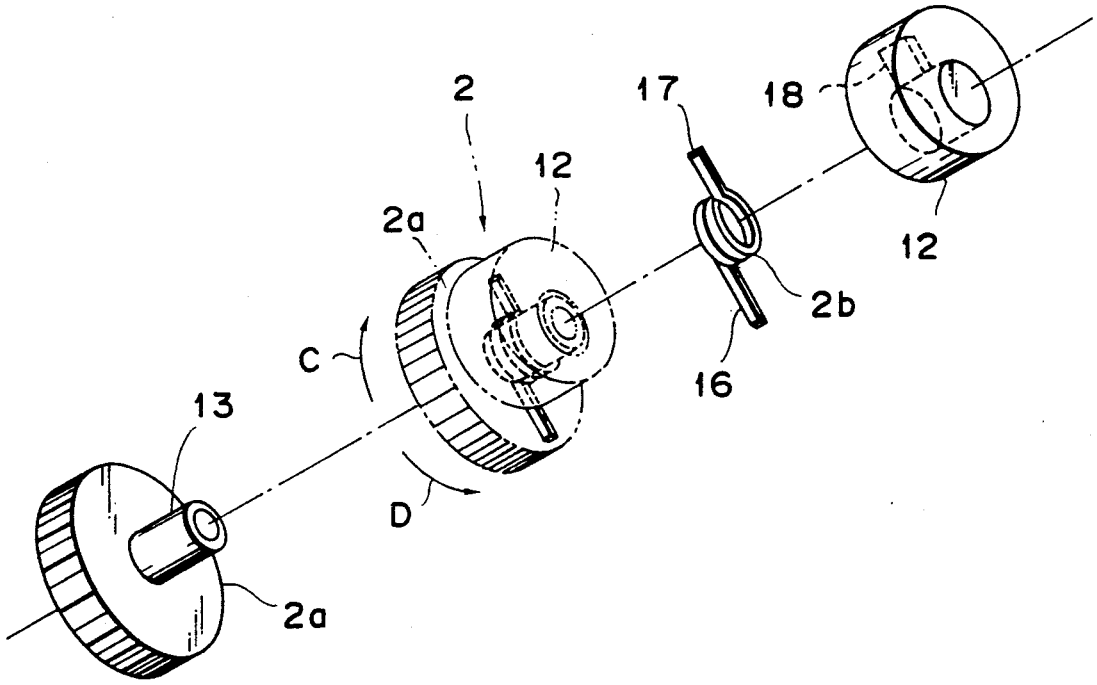
FIG. 6 is an exploded perspective view showing the assembling of a clutch means and a switching means according to another embodiment.

In the embodiment shown in FIG. 6, a clutch spring 2*b* is fitted onto a cylindrical portion 13 of an input gear 2*a* with facing an end 16 of the clutch spring toward the input gear, and then a switching cam 12 is capped onto the clutch spring 2*b* in such a manner that the other end 17 of the clutch spring is inserted into a recess 18 of the switching cam. In a condition so assembled, the clutch spring 2*b* affects an urging force on the input gear 2*a* and the switching cam 12.

With this arrangement, when the input gear 2*a* is rotated in the direction C, the clutch spring 2*b* is tightened due to a friction force between the input gear 2*a* and the end 16 of the clutch spring 2*b*, thus closely contacting the clutch spring 2*b* with the cylindrical portion 13 of the input gear 2*a*. Consequently, since the other end 17 of the clutch spring 2*b* is engaged by the recess 18 of the switching cam 12, the input gear 2*a* is connected to the switching cam 12.

On the other hand, when the input gear 2*a* is rotated in the direction D, since the clutch spring 2*b* is loosened, the spring 2*b* is disconnected from the cylindrical portion 13; however, since the clutch spring 2*b* is urged against both the input gear 2*a* and the switching cam 12, the clutch 2 will be loosely engaged. Briefly speaking, this embodiment differs from that shown in FIG. 2 in the point that the compression spring 2*c* is omitted; however, the same technical effect can be obtained.

Next, a further embodiment will be explained with reference to FIG. 7.

Figure 7:
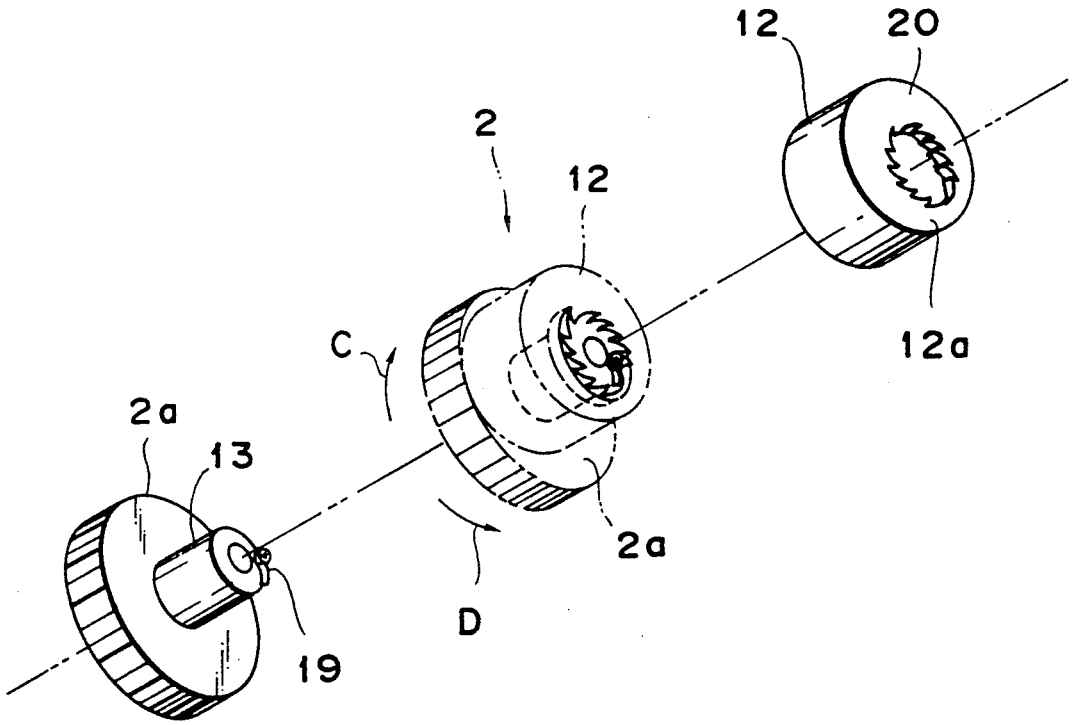
FIG. 7 is an exploded perspective view showing the assembling of a clutch means and a switching means according to further embodiment.

In the embodiment shown in FIG. 7, a hook 19 pivotally mounted on an outer end surface of a cylindrical portion 13 of an input gear 2*a* is biased outwardly. A series of ratchet teeth 20 are formed on a cylindrical surface defining an opening 12*a* in a switching cam 12, so that the hook 19 can be engaged by one of the ratchet teeth 20. When the input gear 2*a* is rotated in the direction C, the hook 19 is engaged by one of the ratchet teeth 20, thus firmly connecting the input gear 2*a* to the switching cam 12. On the other hand, when the input gear 2*a* is rotated in the direction D, since the hook 19 is biased outwardly, the hook 19 loosely contacts with the ratchet teeth 20, thus loosely connecting the input gear 2*a* to the switching cam 12.

Since the function and technical effect obtained by this embodiment are the same as those of the previous embodiments, the explanation thereof will be omitted.

Next, a sheet feeding apparatus according to another embodiment of the present invention will be explained with reference to FIGS. 8 and 9.

This embodiment differs from the first embodiment shown in FIGS. 3 and 4 in the point that the switching cam 12 is replaced by a disc 21 having an arcuated cam slot 22 formed therein, and a base plate 23 pivotally mounted on a pin 23*a* is provided, and a compression spring 24 is inserted between the base plate 23 and an urging plate 7 and a cam follower 25 formed on the base plate 23 is received in the cam slot 22. Incidentally, a right end 22*a* of the cam slot 22 is directed inwardly of the disc 21.

Figure 8:
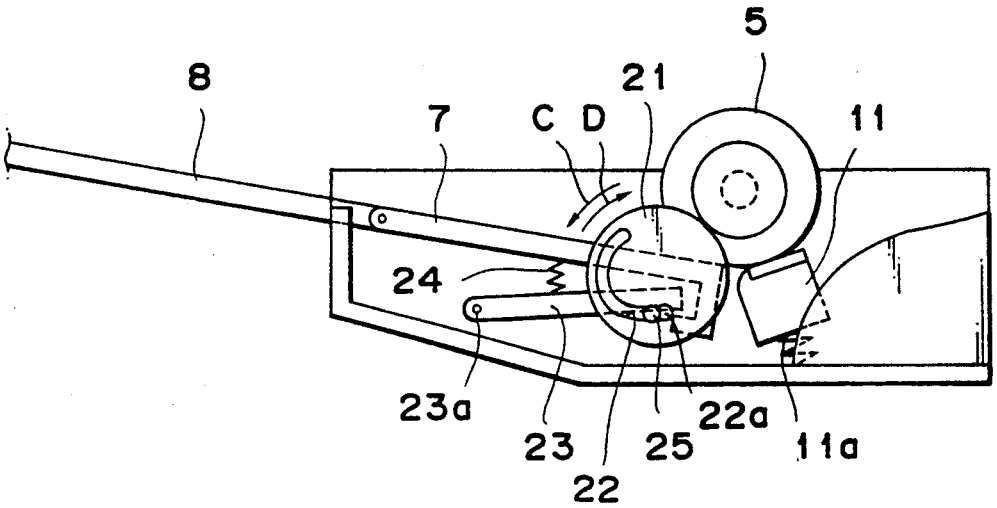
FIG. 8 is an elevational sectional view of a sheet feeding apparatus according to another embodiment, showing a sheet feeding condition.
Figure 9:
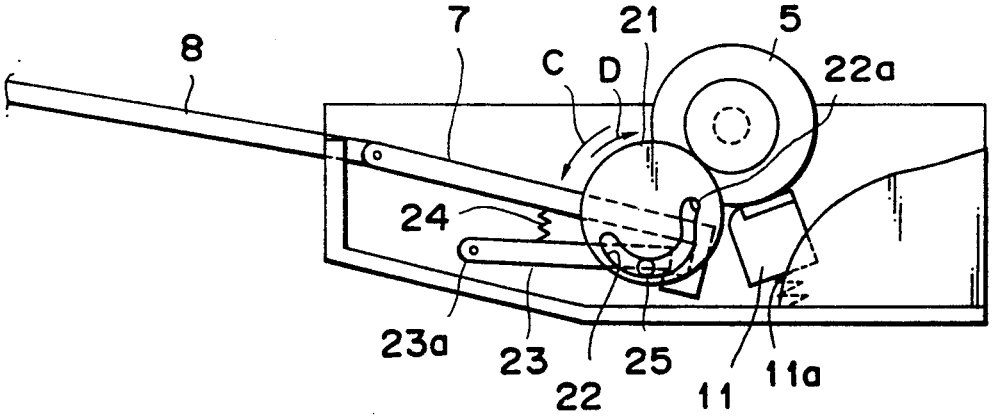
FIG. 9 is an elevational sectional view of the sheet feeding apparatus of FIG. 8, showing a sheet stacking condition.

With this arrangement, when the sheet supply roller 5 is rotated in the direction A (FIG. 1) to feed out the sheets P due to the normal rotation of the motor 3, as shown in FIG. 8, the disc 21 is rotated in the direction D through the loose connection between the disc 21 and the input gear 2*a* until the cam follower 23 is abutted against the right end 22*a* of the cam slot 22. Thereafter, the clutch 2 is slipped while stopping the disc 21; meanwhile, the highest lift profile of the cam slot 22 at the right end 22*a* thereof lifts the base plate 23 upwardly via the cam follower 25, thus urging the urging plate 7 against the sheet supply roller 5 with the aid of the compression spring 24.

Further, as shown in FIG. 8, when the motor 3 is rotated reversely by the predetermined amount, the disc 21 is rotated in the direction C by a predetermined amount due to the engagement of the clutch 2, with the result that the disc is stopped so that the cam follower 25 is positioned in the cam slot 22 at its lowest lift profile. Consequently, the base plate 23 is lowered via the cam follower 25, thus lowering the urging plate 7 with the aid of the compression spring 24 to separate from the sheet supply roller 5. That is to say, the cooperation between the urging plate 7 and the sheet supply roller 5 and the technical effect obtained by such cooperation are the same as those of the previous embodiment.

As mentioned above, since the sheet supply means and the switching means are driven by the same single drive source, and the clutch means, which is firmly engaged in the normal rotational direction (sheet feeding direction of the sheet supply means) and is loosely engaged in the reverse direction, is disposed between the sheet supply means and the switching means, it is possible to drive the sheet supply means and the switching means for switching the urging means between the urging position and the separated position only by the single drive source. Further, since the sheet supply means and the switching means can be properly driven by the normal rotation of the single drive source, it is possible to omit any driving force switching means associated with the drive source and any sensor for detecting the condition of the switching means. Thus, it is possible to make the sheet feeding apparatus considerably less expensive.

Figure 10:
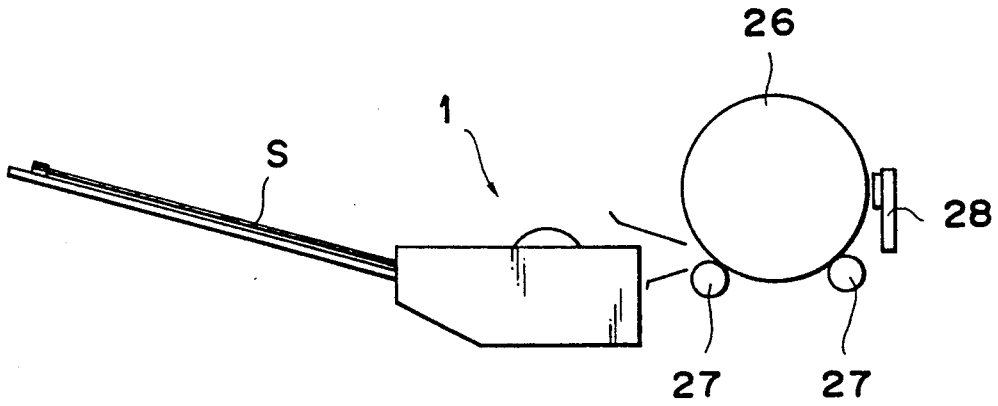
FIG. 10 is a schematic elevational view showing an example of an image forming system incorporating the sheet feeding apparatus of the present invention.

FIG. 10 shows an example of an image forming system incorporating the above-mentioned sheet feeding apparatus therein.

The sheet S fed from the sheet feeding apparatus 1 is pinched between a feed roller 26 and a pinch roller 27 and is fed to a printing portion. In the printing portion, a recording head 28 forms an image on the sheet S on the basis of a print signal. Thereafter, the printed sheet is ejected out of the system.

Incidentally, it should be noted that the sheet feeding apparatus according to the present invention can be applied to not only a system wherein an image is formed on a sheet, but also a system wherein an image is transferred onto a sheet. Further, the sheet feeding apparatus according to the present invention can be used as an original feeding apparatus in a facsimile, copying machine and the like.

What is claimed is:

1. A sheet feeding apparatus, comprising:

support means for supporting stacked sheets, said support means being shiftable between a feed position and a waiting position;

rotary sheet feed means for feeding out the sheets supported by said support means in said feed position;

a rotary drive source for driving said rotary sheet feed means; and switching means connected to said rotary drive source, for shifting said support means to said feed position through rotation of said rotary drive source in one direction and for shifting said support means to said waiting position through the rotation of said rotary drive source in the other direction.

2. A sheet fading apparatus according to claim 1, wherein, when a normal rotation of said rotary drive source is transmitted, said rotary sheet feed means is rotated to feed out the sheets.

3. A sheet fading apparatus according to claim 2, wherein said rotary sheet feed means includes a rotary sheet supply member for feeding the sheet by abutting against the sheets stacked on said support means, and a one-way clutch mechanism for transmitting a normal rotation of said rotary drive source to said rotary sheet supply member and for not transmitting a reverse rotation of said rotary drive source to said rotary sheet supply member.

4. A sheet feeding apparatus according to claim 2, wherein the normal rotation of said rotary drive source causes said support means to shift to said feed position and a reverse rotation of said rotary drive source causes said support means to shift to said waiting position.

5. A sheet feeding apparatus according to claim 4, wherein said support means has an urging plate on which the sheets are stacked, and a biasing means for biasing said urging plate toward said rotary sheet feed means, and said feed position is a position where the sheets are abutted against said rotary sheet feed means by the biasing force of said biasing means and said waiting position is a position where said urging plate is separated from said rotary sheet feed means in opposition to the biasing force of said biasing means.

6. A sheet feeding apparatus according to claim 5, wherein said switching means has a switching cam rotated by said rotary drive source, and said switching cam has a portion which is not abutted against said urging plate and a portion which is abutted against said urging plate to shift said urging plate in opposition to the biasing force of said biasing means.

7. A sheet feeding apparatus according to claim 6, wherein a transmitting means for transmitting a reverse rotation of said rotary drive source substantially without any slip and for slippingly transmitting a normal rotation of said rotary drive source is disposed between said rotary drive source and said switching means.

8. A sheet feeding apparatus according to claim 7, further including a stopper for stopping the rotation of said switching cam by abutting against said switching cam when said transmitting means transmits the normal rotation of said rotary drive source.

9. A sheet feeding apparatus according to claim 8, wherein said transmitting means is disposed between a drive source member at the rotary drive source side and said switching cam, and has a one-way clutch mechanism for transmitting the reverse rotation of said rotary drive source substantially without any slip and a friction generating means for generating a friction force between said drive source member and said switching cam to slippingly transmit the normal rotation of said rotary drive source.

10. A sheet feeding apparatus according to claim 9, wherein said friction force generating means comprises an elastic member for biasing said switching cam toward said drive source member to generate a friction force therebetween.

11. An image forming system, comprising:

support means for supporting stacked sheets, said support means being shiftable between a feed position and a waiting position;

rotary sheet feed means for feeding out the sheets supported by said support means in said feed position;

a rotary drive source for driving said rotary sheet feed means;

switching means, connected to said rotary drive source, for shifting said support means to said feed position through rotation of said rotary drive source in one direction and for shifting said support means to said waiting position through the rotation of said rotary drive source in the other direction; and image forming means for forming images on the sheets fed out by said rotary sheet feed means.

12. An image forming system according to claim 11, wherein , when a normal rotation of said rotary drive source is transmitted, said rotary sheet feed means is rotated to feed out the sheets.

13. An image forming system according to claim 12, wherein the normal rotation of said rotary drive source causes said support means to shift to said feed position and a reverse rotation of said rotary drive source causes said support means to shift to said waiting position.

* * * * *

UNITED STATES PATENT AND TRADEMARK OFFICE

CERTIFICATE OF CORRECTION

PATENT NO. 5,219,155

DATED June 15, 1993

INVENTOR(S) Yuji Kanome

It is certified that error appears in the above-indentified patent and that said Letters Patent is hereby corrected as shown below:

Column 1, line 57, "Further" should read --Further,--.

Column 3, line 21, "shownin" should read --shown in--
line 40, "am 12" should read --cam 12--.

Column 7, line 38, "fading" should read --feeding--
line 42, "fading" should read --feeding--.

Signed and Sealed this

Fifteenth Day of March, 1994

Bruce Lehman

*Attest:*

BRUCE LEHMAN

*Attesting Officer*

*Commissioner of Patents and Trademarks*